US011400325B1

(12) United States Patent
Stodola

(10) Patent No.: US 11,400,325 B1
(45) Date of Patent: Aug. 2, 2022

(54) FIRE SUPPRESSION SYSTEM

(71) Applicant: James Stodola, Cambridge, MN (US)

(72) Inventor: James Stodola, Cambridge, MN (US)

( * ) Notice: Subject to any disclaimer, the term of this patent is extended or adjusted under 35 U.S.C. 154(b) by 258 days.

(21) Appl. No.: 16/943,343

(22) Filed: Jul. 30, 2020

(51) Int. Cl.
*A62C 3/00* (2006.01)
*A62C 37/12* (2006.01)
*G08B 25/10* (2006.01)

(52) U.S. Cl.
CPC ..... *A62C 3/006* (2013.01); *A62C 37/12* (2013.01); *G08B 25/10* (2013.01)

(58) Field of Classification Search
CPC ..... A62C 3/006; A62C 37/11; A62C 37/12
See application file for complete search history.

(56) References Cited

U.S. PATENT DOCUMENTS 3,613,793 A * 10/1971 Huthsing, Jr. ..... A62C 35/605 169/42
3,754,602 A * 8/1973 Magdars ..... A62C 3/10 169/42
3,889,754 A * 6/1975 Dunn ..... A62C 3/006 169/59
4,191,257 A * 3/1980 Mohler ..... A62C 37/20 251/147
4,256,181 A * 3/1981 Searcy ..... A62C 37/12 169/65
4,773,485 A * 9/1988 Silverman ..... A62C 3/006 169/59
4,813,487 A * 3/1989 Mikulec ..... F24C 15/2021 251/74
4,834,188 A * 5/1989 Silverman ..... A62C 3/04 169/59
5,127,479 A * 7/1992 Stehling ..... A62C 3/006 285/31
5,351,760 A * 10/1994 Tabor, Jr. ..... A62C 3/006 169/59
5,730,170 A * 3/1998 Sanchez ..... F16K 17/383 137/554
5,771,977 A * 6/1998 Schmidt ..... A62C 37/12 169/26
7,182,143 B2 2/2007 Hall
9,907,985 B2 * 3/2018 Almutairi ..... F16K 17/383
10,486,895 B2 * 11/2019 Stille ..... A62C 13/78
2005/0126797 A1 * 6/2005 Mikulec ..... A62C 37/38 169/65

(Continued)

*Primary Examiner* — Joseph A Greenlund
(74) *Attorney, Agent, or Firm* — Sanchelima & Associates, P.A.; Christian Sanchelima; Jesus Sanchelima

(57) ABSTRACT

A fire suppression system including an extinguisher assembly, a trigger assembly and a communication assembly is disclosed. The extinguisher assembly including a fire extinguisher having a fire retardant within. The fire extinguisher including a plurality of nozzles aimed in various direction for dispersing the fire retardant in multiple directions. The trigger assembly being atop of the fire extinguisher. A lever included within the trigger assembly to actuate the trigger when needed. The lever suspended above of the trigger by a melting pillar. The melting pillar melting when temperatures from a fire within the appliance reach a predetermined threshold to allow said lever to engage the trigger from above. Thereby causing the fire retardant to be dispersed in multiple directions by the plurality of nozzles to extinguish the fire. This helps to protect users from costly repairs and potentially dying within the fire.

11 Claims, 3 Drawing Sheets

(56) References Cited

U.S. PATENT DOCUMENTS

| | | | | |
|---|---|---|---|---|
| 2011/0214888 | A1* | 9/2011 | Alchalel | A62C 37/36<br>169/46 |
| 2015/0129246 | A1* | 5/2015 | Kronebusch | A62C 13/76<br>169/59 |
| 2016/0296779 | A1* | 10/2016 | Almutairi | A62C 2/12 |
| 2017/0266473 | A1* | 9/2017 | Bohrer | A62C 3/006 |
| 2018/0169450 | A1* | 6/2018 | Moffa | G08B 29/145 |
| 2021/0138286 | A1* | 5/2021 | Bouchard | A62C 37/50 |

* cited by examiner

FIRE SUPPRESSION SYSTEM

BACKGROUND OF THE INVENTION

1. Field of the Invention.

The present invention relates to a fire suppression system and, more particularly, to a fire suppression system that automatically extinguishes fires detected within appliances.

2. Description of the Related Art.

Several designs for fire suppression systems have been designed in the past. None of them, however, include fire suppression system with a multi-point fire retardant dispersion within a specific area. The fire suppression system is capable of extinguishing fires started by appliances by extinguishing the fire from within the appliance. Importantly, the fire suppression system deluges the fire by dispersing the fire retardant in multiple directions. Additionally, the fire suppression system is able to alert and warn users of the hazardous fire occurring.

Applicant believes that a related reference corresponds to U.S. Pat. No. 7,182,143 for an automatic appliance fire extinguisher system. Applicant believes that another related reference corresponds to U.S. Pat. No. 5,351,760 for a fire suppression system and method for its use. None of these references, however, teach of a fire suppression system capable of dispersing the fire retardant in multiple directions at once to extinguish the fire.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a fire suppression system capable of multi-point fire retardant dispersion for extinguishing a fire.

It is another object of this invention to provide a fire suppression system that can be retrofitted within existing appliances.

It is still another object of the present invention to provide a fire suppression system that increases the safety of users by automatically alerting the users of the fire occurring and also extinguishes the fire automatically.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
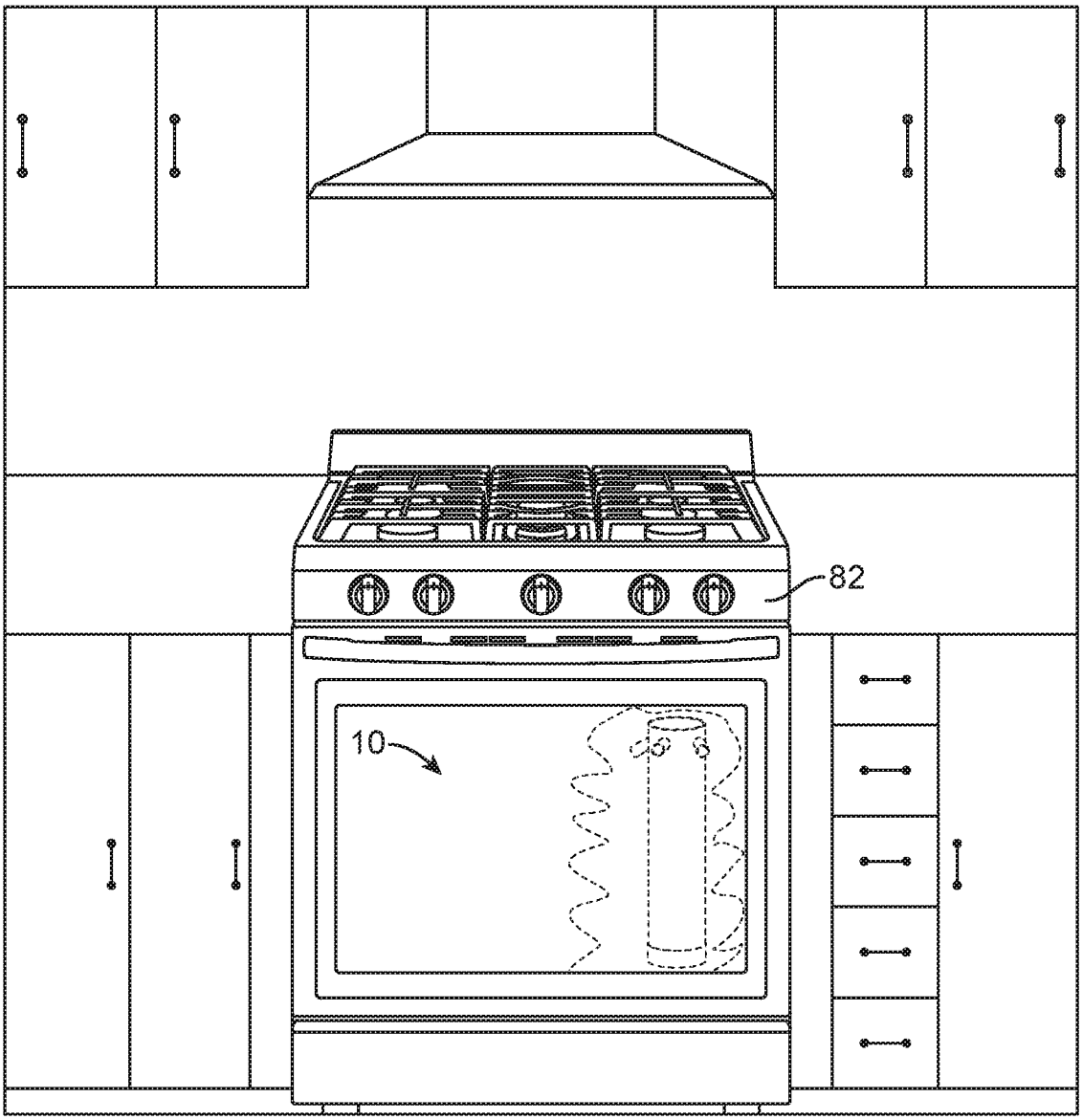
FIG. 1 represents an operational setting in which fire suppression system 10 is mounted within an appliance 82 to extinguish a fire within appliance 82.

Referring now to the drawings, where the present invention is generally referred to with numeral 10, it can be observed that it basically includes an extinguisher assembly 20, a trigger assembly 40 and a communications assembly 60.

Fire suppression system 10 as best shown in FIG. 1, can be retrofitted within an appliance 82. Preferably, fire suppression system 10 may be located at a corner within appliance 82. Fire suppression system 10 is able to detect and alert a user of a fire that has started within appliance 82. Further, the fire suppression system 10 is able to automatic extinguish the fire detected. Thereby increasing the safety of the user by preventing the fire from becoming uncontrollable. An uncontrollable fire could lead to the entire house, establishment being burned down or a person being killed by the fire which would be costly and devastating. Fire suppression system 10 provides added safety and peace of mind to the user.

Figure 2:
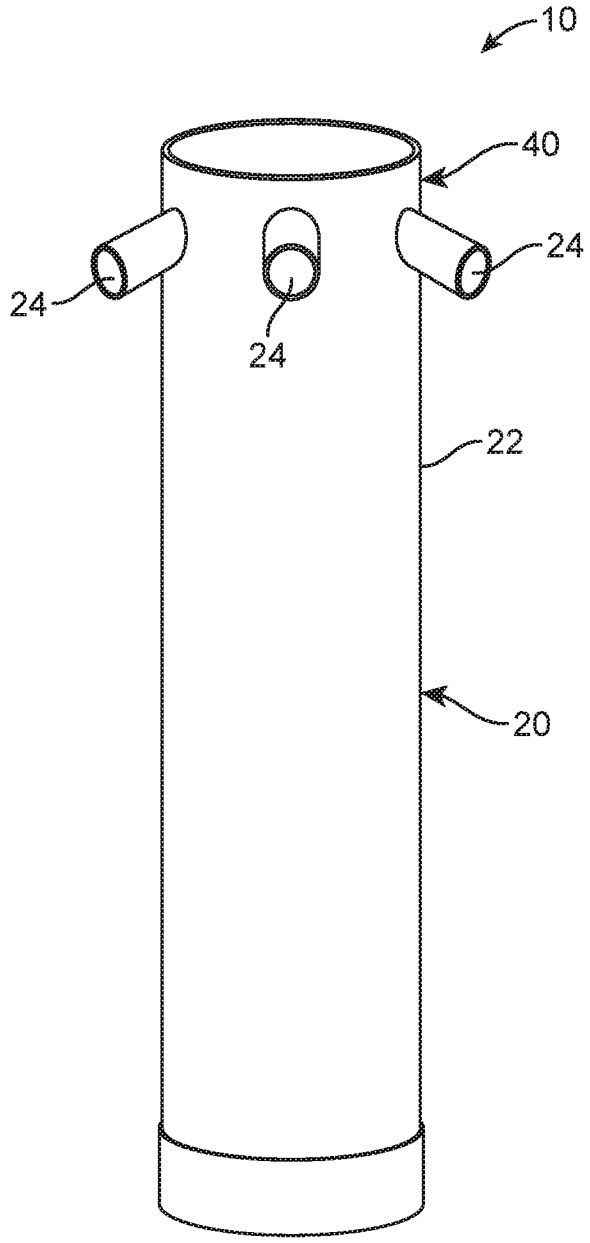
FIG. 2 shows an isometric view of fire suppression system 10.

As best shown in FIG. 2, fire suppression system 10 includes extinguisher assembly 20. Extinguisher assembly 20 may preferably be entirely secured within appliance 82. Extinguisher assembly 20 may include a fire extinguisher 22. Fire extinguisher 22 may be of predetermined dimensions that cooperate with fitting within appliance 82. In one embodiment, fire extinguisher 22 may have a cylindrical shaped body that contains a fire retardant within. However, it is to be understood that other shapes may be suitable for fire extinguisher 22. Fire extinguisher 22 may be made of materials such as metal, plastic, rubber, stainless steel, aluminum or the like. Fire retardant is dispersed or released by fire extinguisher 22 once there is a need to extinguish a fire. Importantly, atop of fire extinguisher 22 may be nozzles 24. Suitably, nozzles 24 may also be referred to as a plurality of nozzles 24. Nozzles 24 may be aimed in multiple different directions. In one embodiment, nozzles 24 may be orthogonal to one another. Nozzles 24 permit for a multi-point dispersion of the fire retardant once there is a need to extinguish fires. Thereby allowing for a fire within appliance 82 to be extinguished with the fire retardant by engulfing the fire or flames with the fire retardant from multiple directions and angles. It is to be understood that at least one of nozzles 24 may be perpendicular to fire extinguisher 22. Other of nozzles 24 may be angled and face forwardly. Some of nozzles 24 may be angled a predetermined amount. Nozzles 24 may extend outwardly and away from fire extinguisher 22.

Figure 3:
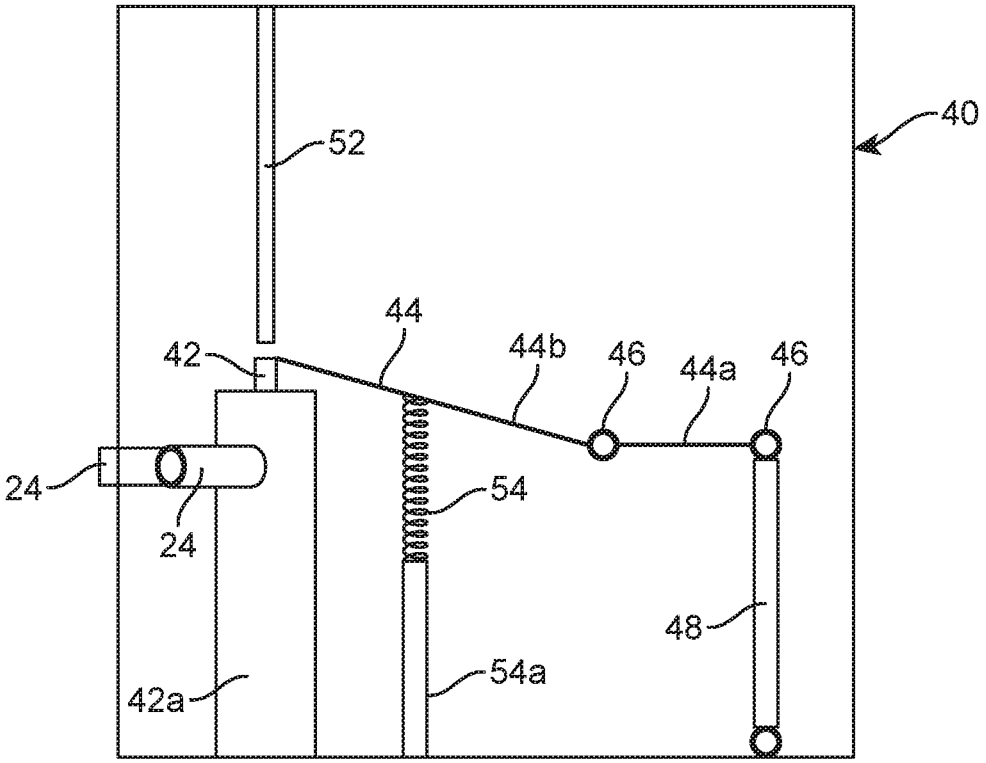
FIG. 3 illustrates a zoomed in view of trigger assembly 40.

Trigger assembly 40, as best shown in FIG. 3, may be used to release the fire retardant within fire extinguisher 22. It can be seen that trigger assembly 40 may be located at a top portion of fire extinguisher 22. Trigger assembly 40 may include a trigger 42. Trigger 42 may be actuated to release or disperse the fire retardant from within fire extinguisher 22 through nozzles 24. Trigger 42 may be a switch or button that is pressed to be actuated. Trigger 42 may be mounted atop of a trigger support 42*a*. Trigger support 42*a* may be entirely below trigger 42. It may be suitable for trigger support 42*a* to be partially hollow. Mounted to trigger support 42*a* may be nozzles 24. It is to be understood that each of nozzles 24 may extend in a different direction from trigger support 42*a*.

Trigger 42 may be actuated by a lever 44 to release the fire retardant from fire extinguisher 22. It is to be understood that lever 44 may include a first lever portion 44*a* and second lever portion 44*b*. First lever portion 44*a* and second lever portion 44*b* may be secured together with hinges 46. First lever portion 44*a* may be adjacent to second lever portion 44*b*. In one embodiment, first lever portion 44*a* may be shorter than second lever portion 44*b*. Second lever portion 44*b* may be nearest to trigger 42. It is to be understood that lever 44 is to hover above of trigger 42 until there is a need to actuate trigger 42. Lever 44 may be supported by first melting pillar 48 at first lever portion 44*a*. First melting pillar 48 may be entirely beneath of lever 44. Lever 44 may also be supported by second melting pillar 52. Second melting pillar 52 attaches to second lever portion 44*b* to suspend lever 44 above of trigger 42. It is to be understood that once there is a fire within appliance 82, first melting pillar 48 and second melting pillar 52 may melt upon a predetermined temperature being reached. It is to be understood that first melting pillar 48 and second melting pillar 52 are the only components of the present invention that are not entirely able to withstand fire. Once first melting pillar 48 and second melting pillar 52 have melted, lever 44 may then fall down on trigger 42 to actuate trigger 42.

To further ensure that lever 44 actuates trigger 42 upon second melting pillar 52 melting away, a spring 54 may be attached underneath of lever 44. Spring 54 may be mounted atop of spring support 54*a*. With second melting pillar 52 intact, spring 54 may expanded due to lever 44 being attached to second melting pillar 52. Upon second melting pillar 52 being melted, spring 54 may compress and pull lever 44 towards trigger 42 to dispense the fire retardant through the plurality of nozzles 24 to extinguish the fire within appliance 82.

Figure 4:
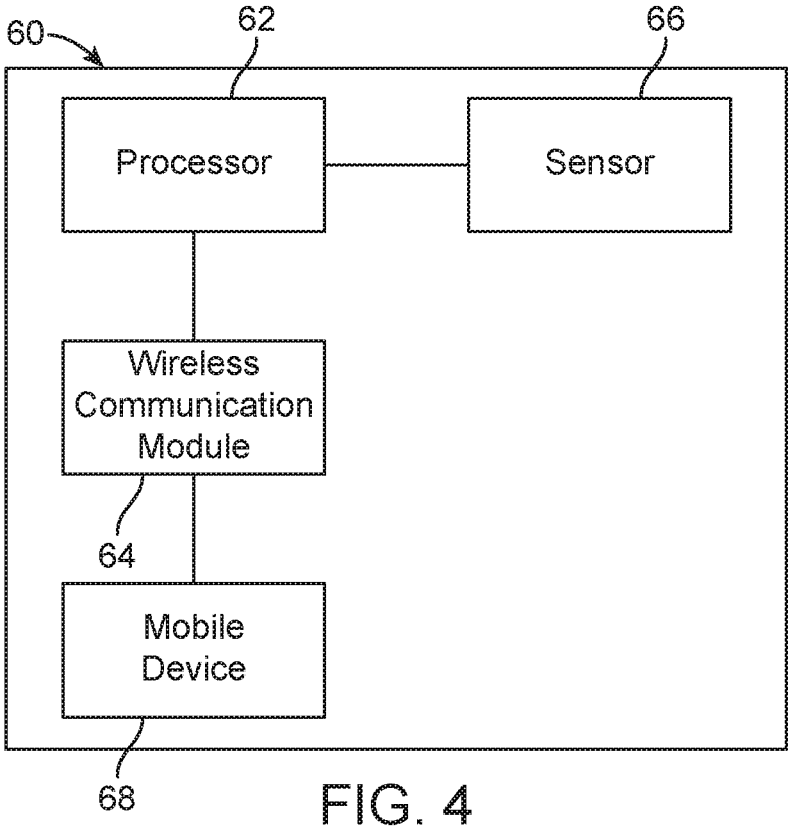
FIG. 4 is a representation of a flowchart of communication assembly 60.

Importantly, fire suppression system 10 may further include communication assembly 60, as best seen in FIG. 4. Communication assembly 60 may be used to notify users that a fire is occurring at appliance 82. Communication assembly 60 may include a processor 62. It may be necessary for processor 62 to be connected to a power source. Mounted onto processor 62 may be a wireless communication module 64 that may be used to communicate with a mobile device 68. Also mounted onto processor 62 may be a sensor 66. In one embodiment, sensor 66 may be a temperature sensor. Sensor 66 may detect when the temperature within appliance 82 is too high to indicate that a fire is starting. Sensor 66 may be programmed to alert of a temperature reaching above a predetermined threshold. Once sensor 66 has determined the temperature has reached beyond the predetermined threshold, processor 62 may use wireless communication module 64 to notify users through mobile device 68 that a fire may be occurring. Mobile device 68 may be notified of the temperature detected, the location and the time of the notification, in one embodiment. It may be suitable for the notification to mobile device 68 may be in the form of a text message, email, call, video call, pop up message or combinations thereof.

It is to be understood that fire suppression system 10 may be used to extinguish fires within appliance 82 before the fire becomes uncontrollable and causes extensive damage. The present invention may further help to improve the safety of users by extinguishing the fire even if the user is unaware of the fire. Importantly, fire extinguisher 22 is secured within appliance 82. Upon a fire starting and causing second melting pillar 52 to melt, lever 44 is released and trigger is actuated to dispense the fire retardant within fire extinguisher 22. The fire retardant is released through plurality of nozzles 24 to engulf the fire from multiple points or angles.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fire suppression system, comprising:

a) an extinguisher assembly including a fire extinguisher, said fire extinguisher including a plurality of nozzles aimed in different directions;

b) a trigger assembly secured atop of said fire extinguisher, said trigger assembly including a trigger, said trigger assembly further including a lever, said lever suspended over said trigger by a first melting pillar and a second melting pillar, said lever being over said trigger, said first melting pillar and said second melting pillar selectively melting upon a predetermined threshold being reach, said lever releasing from said second melting pillar and actuating said trigger;

c) an appliance, said fire extinguisher secured within said appliance, said fire extinguisher dispersing a fire retardant through said plurality of nozzles to extinguish a fire within said appliance; and d) wherein said lever includes a first lever portion and a second lever portion, said first lever portion being shorter than said second lever portion, said second lever portion being in selective abutting contact with said second melting pillar at a first end of said lever and said first melting pillar is located beneath said first lever portion at a second end of said lever.

2. The system of claim 1, said trigger mounted onto a trigger support atop of said fire extinguisher, said plurality of nozzles extending outwardly and away from said trigger support, at least one of said nozzles being perpendicular to said trigger support.

3. The system of claim 1, wherein said second lever portion hovers over said trigger.

4. The system of claim 1, wherein said first lever portion and said second lever portion are secured together with hinges.

5. The system of claim 1, wherein a spring and a spring support are entirely underneath of said lever, said spring being mounted atop of said spring support.

6. The system of claim 5, wherein said spring being in constant abutting contact with said lever on an underside thereof, said spring being expanded when said second melting pillar is intact, said spring compressing and pulling said lever towards said trigger when said second melting pillar has melted.

7. The system of claim 1, wherein a communication assembly is within said fire extinguisher, said communication assembly including a processor, a wireless communication module, a sensor and a mobile device.

8. The system of claim 7, wherein said sensor is a temperature sensor.

9. The system of claim 7, wherein said sensor detects when temperature within said appliance is above a predetermined threshold, said sensor communicating with said processor with collected data.

10. The system of claim 9, wherein said collected data is transmitted to said mobile device by said processor with said wireless communication module, said mobile device being alerted of said appliance catching fire.

11. The system of claim 10, wherein said mobile device is alerted via a text message, email, call, video call, pop up message or combinations thereof.

* * * * *